US006042164A

United States Patent [19]

Merritt

[11] Patent Number: 6,042,164

[45] **Date of Patent: *Mar. 28, 2000**

[54] CONTAINER LIFTER WITH MOVABLE KEEPER

[76] Inventor: James A. Merritt, P.O. Box 206, Pleasanton, Calif. 94566

[ * ] Notice: This patent issued on a continued prosecution application filed under 37 CFR 1.53(d), and is subject to the twenty year patent term provisions of 35 U.S.C. 154(a)(2).

[21] Appl. No.: 09/151,873

[22] Filed: Sep. 11, 1998

[51] Int. Cl.[7] ..... B65D 23/10; B65G 7/12

[52] U.S. Cl. ..... 294/28; 294/27.1

[58] Field of Search ..... 294/15, 16, 27.1, 294/28, 31.1, 31.2, 34, 87.2, 87.22, 87.24, 87.28, 90–92, 137, 164–166; 215/396, 397; D9/434, 455

[56] References Cited

U.S. PATENT DOCUMENTS

| | | | |
|---|---|---|---|
| D. 334,888 | 4/1993 | Merritt . | |
| D. 340,789 | 10/1993 | Merritt . | |
| 1,411,695 | 4/1922 | Hackett | 294/87.22 |
| 1,777,102 | 9/1930 | Mooney | 294/28 |
| 2,067,124 | 1/1937 | Hoffman | 294/87.28 |
| 2,140,314 | 12/1938 | Doscher | 294/87.24 |
| 2,308,744 | 1/1943 | Buys | 294/28 |
| 2,363,950 | 11/1944 | Fearon | 294/87.22 |
| 2,404,625 | 7/1946 | Druhot | 294/87.22 |
| 2,409,684 | 10/1946 | Jenkins | 294/87.22 |
| 2,534,512 | 12/1950 | Fulton | 294/28 |
| 3,101,211 | 8/1963 | Jones | 294/27.1 |
| 3,520,570 | 7/1970 | Christopher et al. . | |
| 3,963,206 | 6/1976 | Scolaro et al. . | |
| 4,236,743 | 12/1980 | Fox | 294/27.1 |
| 4,273,246 | 6/1981 | Thompson . | |
| 4,753,474 | 6/1988 | Radford . | |
| 4,936,614 | 6/1990 | Russell . | |
| 5,085,477 | 2/1992 | Gagnon | 294/28 |

FOREIGN PATENT DOCUMENTS

| | | | |
|---|---|---|---|
| 165764 | 4/1950 | Austria | 294/27.1 |
| 707856 | 1/1980 | U.S.S.R. . | |
| 83/02101 | 6/1983 | WIPO . | |

OTHER PUBLICATIONS

"The All New Bottle Cady II® Back–Saving Water Bottle Carrier", Advertising Brochure/Order Form, M&B Manufacturing, Pleasanton, CA 94588.

*Primary Examiner*—Johnny D. Cherry
*Attorney, Agent, or Firm*—Townsend and Townsend and Crew, LLP

[57] ABSTRACT

A container lifter (2) is designed for use with a container (6) of the type having a body and a neck (4) extending from the body. The neck has an enlarged-diameter portion (24) and a reduced-diameter portion (28). The container lifter has a collar (8) which defines a collar opening (22) sized to permit the enlarged-diameter portion to pass therethrough. A keeper (14) is mounted to the collar for movement between a first position, spaced apart from the collar opening, and second position, partially covering the collar opening to define a reduced collar opening (26). The reduced collar opening is sized to permit the reduced-diameter portion to pass therethrough but prevent the enlarged-diameter portion from passing therethrough. The container lifter also includes a handle (32), extending from the collar, having a handgrip (34) which is generally centered on the reduced collar opening. This configuration helps to ensure that the collar and keeper properly engage the neck when the container lifter is used to pull the container generally horizontally or to lift the container generally vertically.

2 Claims, 4 Drawing Sheets

CONTAINER LIFTER WITH MOVABLE KEEPER

CROSS REFERENCE TO RELATED APPLICATIONS

This application is related to U.S. patent application Ser. No. 09/128,355 filed Aug. 3, 1998, now U.S. Pat. No. 5,957,513, and entitled "Container Lifter". This application is also related to U.S. Design Pat. Nos. DES 334,888 and DES 340,789.

BACKGROUND OF THE INVENTION

The present invention is directed to a container lifter, in particular a container lifter specially suited for lifting large water bottles and removing water bottles from support structures.

Many containers having necks, but no handles, are difficult to lift and carry or to remove from a support structure. This is especially true for large water bottles, such as the 5-gallon variety delivered to home and office. Due to the weight and awkward size of such bottles, many people experience difficulty moving them. Many lack the strength or grip for handling such bottles. People often resort to pushing or rolling such bottles to move them from place to place.

Conventional bottle lifters are often subject to one or more deficiencies. These bottle lifters may prematurely disengage from the bottle neck, which may result in the bottle dropping to the ground. This may be the result of the bottle lifter simply slipping off the neck of the bottle. Also, some bottle lifters apply a concentrated force on the cap or lid covering the bottle opening when the bottle is lifted; this can cause the cap or lid to be partially or totally removed from the bottle. Such dislodgement of the cap or lid may also permit the bottle lifter to slip off the bottle.

Another problem is created during the delivery of such bottles. Typically, the containers are delivered to homes and offices by delivery truck. These trucks have a support structure for the containers which places them horizontally. This horizontal position facilitates movement and storage of the containers while on the delivery truck. However, it is often difficult and awkward to remove the containers from the support structures and then move them to their respective destinations.

SUMMARY OF THE INVENTION

The present invention is directed to a container lifter which is easy to use for both lifting vertically- and horizontally-oriented containers, prevents dislodgement of the lid or cap covering the bottle opening, and effectively eliminates inadvertent disengagement of the bottle lifter from the bottle.

The container lifter is designed for use with a container of the type having a body and a neck extending from the body. The neck has an enlarged-diameter portion, typically at the rim of the neck defining the container opening, and a reduced-diameter portion, between the enlarged-diameter portion and the body of the container. The container lifter has a collar which defines a collar opening sized to permit the enlarged diameter portion to pass through the collar opening. A keeper is mounted to the collar for movement between a first position, spaced apart from the collar opening, and second position, partially covering the collar opening to define a reduced collar opening. The reduced collar opening is sized to permit the reduced-diameter portion to pass therethrough but prevent the enlarged-diameter portion to pass therethrough. This configuration permits the container lifter to be securely secured to the neck of the container. The container lifter also includes a handle, which preferably extends from the collar having a handgrip which is generally centered on the reduced collar opening. This positioning of the handgrip helps to ensure that the collar and keeper properly engage the neck and do not tilt or cock when the container lifter is used to pull the container generally horizontally or to lift the container generally vertically.

A primary advantage of the invention is that the use of the movable keeper helps to eliminate containers slipping from the container lifter. Positioning the handle grip centered on the reduced collar opening helps to insure that the container lifter properly engages and remains engaged with the neck of the bottle or other container.

It is preferred that the collar and keeper be shaped to generally conform to the shape of the neck so that a substantial portion, preferably at least about 60°, and more preferably at least about 300°, of the circumference of the neck is engaged. Also, it is preferred that the keeper be biased toward the second position to facilitate one-handed operation of the container lifter.

Other features and advantages of the invention will appear from the following description in which the preferred embodiments have been set forth in detail in conjunction with the accompanying drawings.

DESCRIPTION OF THE PREFERRED EMBODIMENT

Figure 1:
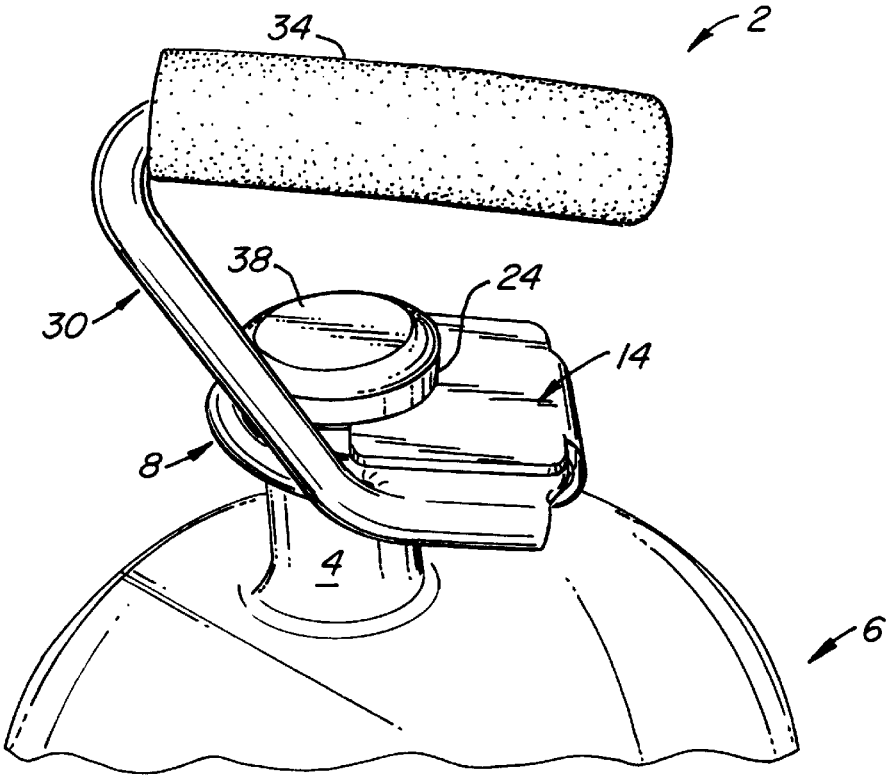
FIG. 1 is an overall perspective view of a container lifter made according to the invention mounted to the neck of a bottle.
Figure 2:
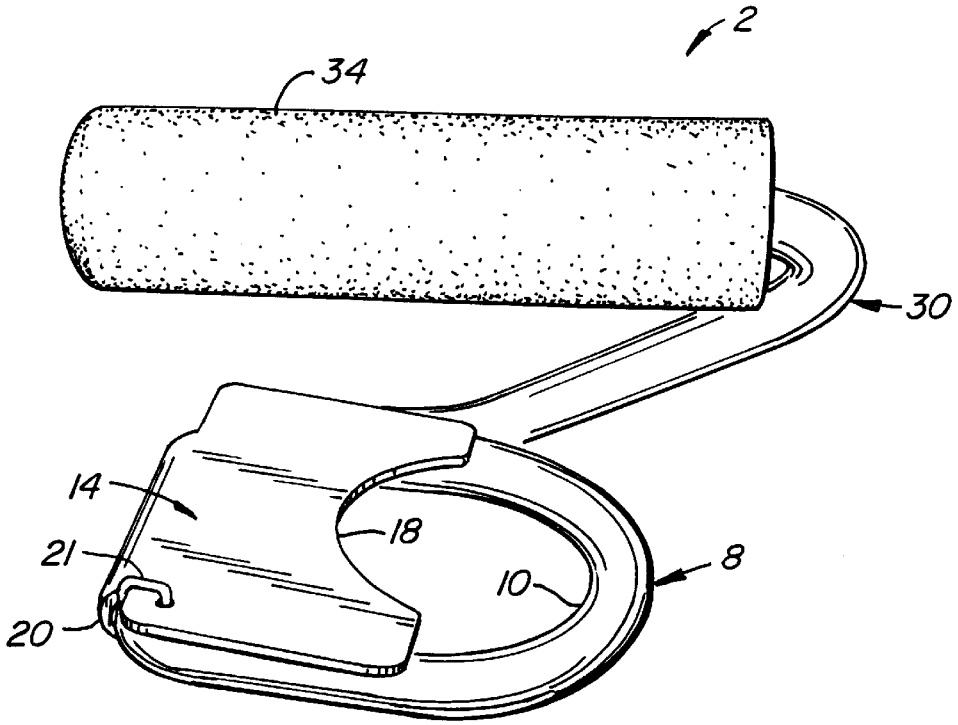
FIG. 2 is a reverse perspective view of the bottle lifter of FIG. 1.
Figure 3:
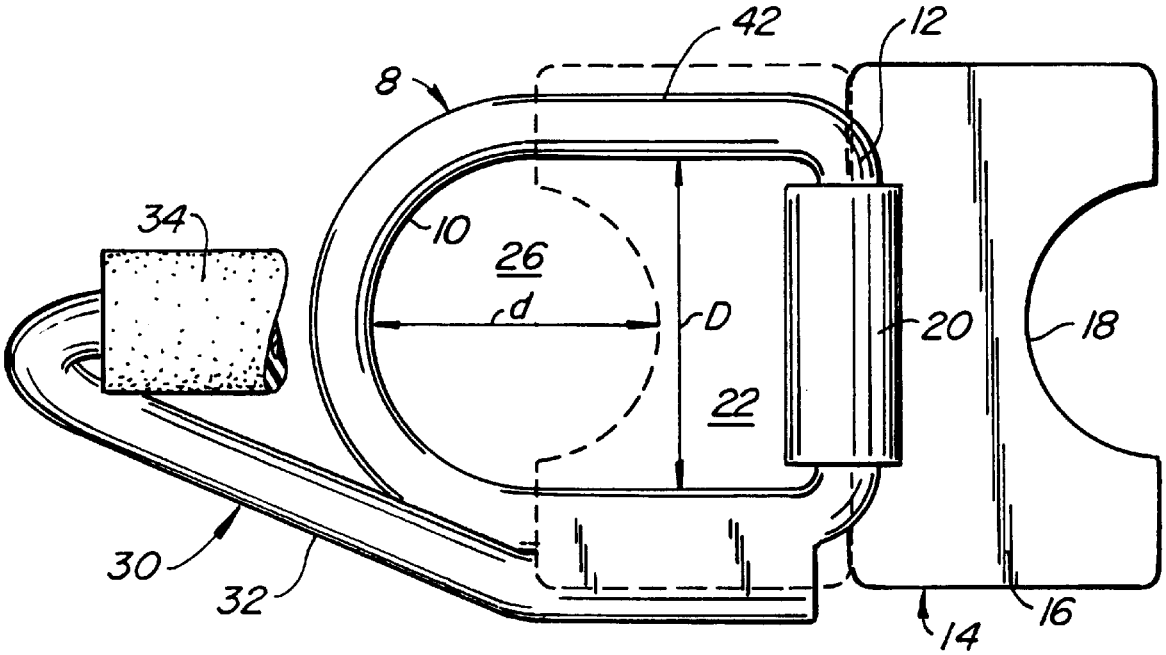
FIG. 3 is a top plan view of the container lifter of FIG. 1 with the keeper pivoted 180° from the neck engagement position of FIGS. 1 and 2 illustrating the collar opening defined by the collar, and shown in dashed lines in the neck engagement position of FIGS. 1 and 2 illustrating the reduced collar opening defined by the collar and keeper.

FIG. 1 illustrates a container lifter 2 mounted to the neck 4 of a bottle 6. Referring also to FIGS. 2 and 3, container lifter 2 includes broadly a generally U-shaped collar 8 having a curved bottle engaging portion 10 and a straight portion 12. Collar 8 is, in this disclosed embodiment, made of round bent metal, typically ½" diameter steel or aluminum stock. Container lifter 2 also includes a keeper 14 pivotly mounted to straight portion 12 of collar 8. Keeper 14 includes a planar portion 16 having a neck-engaging, arcuate edge 18 along one side of planar portion 16 and a tubular sleeve 20, surrounding straight portion 12, at the other side of planar portion 16. Keeper 14 is also, in this embodiment, made of metal. While collar 8 and keeper 14 are preferably made of metal, other materials, such as plastics and composites, can also be used.

Figure 2A:
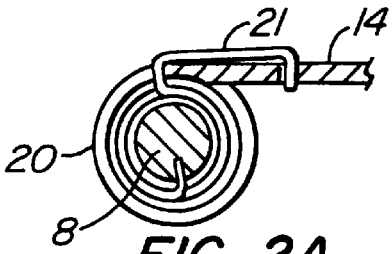
FIG. 2A is a partial cross-sectional view of the collar and keeper of FIG. 2 showing a torsion spring which biases the keeper towards the position of FIG. 2.
Figure 2B:
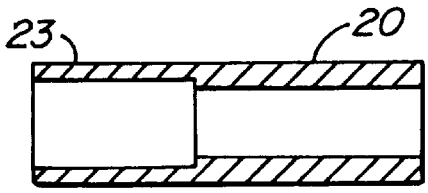
FIG. 2B is a longitudinal cross-sectional view of the sleeve of FIG. 2.

Keeper 14 is spring biased from the solid line position of FIG. 3 towards the dashed line, neck-engagement position of FIG. 3. Spring 21, shown in FIGS. 2 and 2A only, is a torsion spring which biases keeper 14 towards the dashed line, neck-engagement position of FIG. 3. The inside diameter of one end 23 of sleeve 20, see FIG. 2B, is larger than the other end to accommodate torsion spring 21. The neck-engagement position is also illustrated in FIGS. 1 and 2. When keeper 14 is in the solid line position of FIG. 3, the generally D-shaped collar opening 22 of collar 8 is free to pass over the enlarged-diameter portion 24 of bottle neck 4, as will be discussed in more detail below. When keeper 14 is in the neck-engagement position, keeper 14 and collar 8 define a generally circular, reduced collar opening 26. Opening 26 is sized to accept the reduced-diameter portion 28 of bottle neck 4. However, reduced collar opening 26 is also sized small enough to prevent enlarged-diameter portion 24 of neck 4 from passing through collar opening 26 thus securing container lifter 2 to neck 4 of bottle 6. This will be discussed in more detail with reference to FIGS. 4, 5 and 6.

Container lifter 2 also includes a handle 30. In the disclosed embodiment of FIGS. 1–3, handle 30 includes a ½" diameter bent metal rod 32 with one end welded to collar 8 and the other end covered with a 1⅜" diameter cushioned handgrip 34. In the preferred embodiment handgrip 34 is centered on reduced collar opening 26 to ensure that the lifting or pulling force exerted by container lifter 2 on bottle 6 is a generally axially-applied force applied generally along the axis 36 of bottle neck 4. This helps to ensure that container lifter 2 applies a generally even force around bottle neck 4 to help distribute the force and to prevent the twisting or cocking of container lifter 2 relative to bottle neck 4. This helps to prevent undue stresses on bottle neck 4, helps to prevent the inadvertent dislodgement of the protective cap 38 used on water bottles, and helps to prevent container lifter 2 from slipping off of bottle neck 4.

The present invention can be used to both lift and transport generally vertically-oriented bottles as well as pull horizontal-oriented bottles from, for example, delivery trucks and then, after the bottles have swung down to a generally vertical orientation, transport the bottles to the desired location. For ease of discussion, container lifter 2 will be described with reference to a vertically-oriented water bottle 6.

Figure 4:
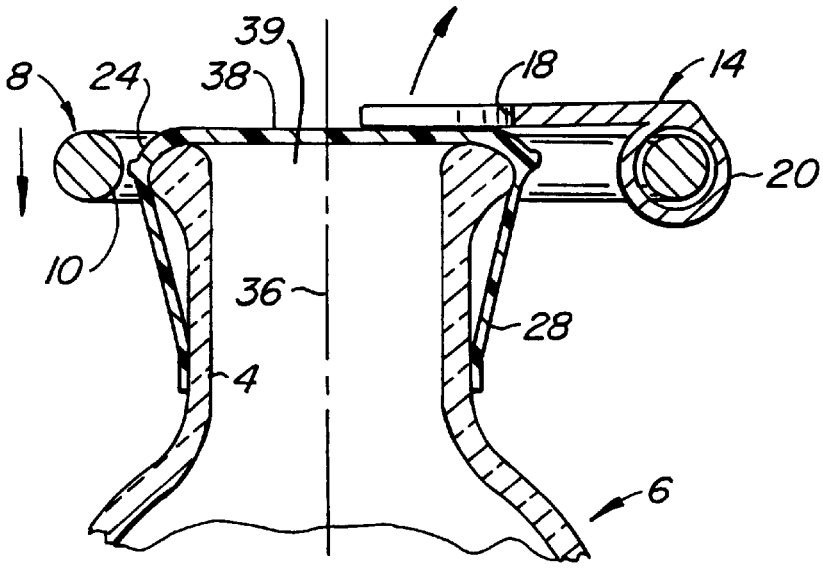
FIG. 4 is a cross-sectional view of the neck of the bottle and the collar and keeper of FIG. 1 illustrating how the spring-biased keeper initially engages the top of the bottle as the enlarged-diameter portion of the neck passes through the collar opening.
Figure 5:
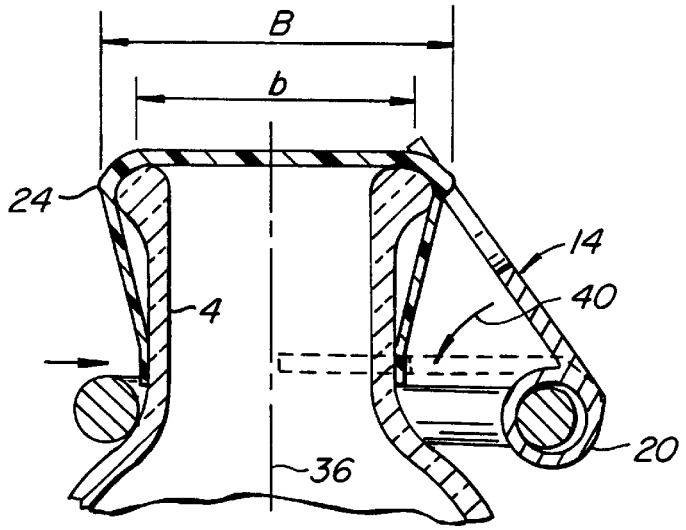
FIG. 5 illustrates the structure of FIG. 4 after the collar has been moved downwardly over the bottle neck and to the right in FIG. 5 to permit the spring-biased keeper to pivot from its solid-line position to its dashed-line position.
Figure 6:
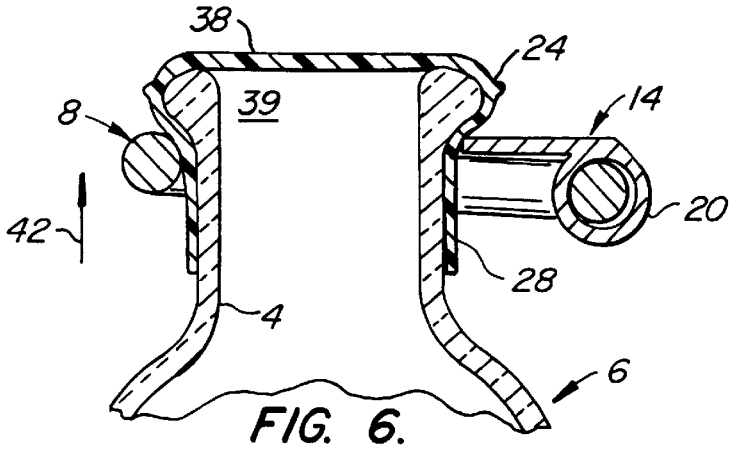
FIG. 6 shows the structure of FIG. 5 after the bottle lifter has moved upwardly causing the collar and keeper to abut the enlarged diameter portion of the neck as shown in FIG. 1.

FIG. 4 illustrates container lifter 2 being mounted to neck 4 of bottle 6 with enlarged diameter portion 24 of neck 4 situated within collar opening 22 and planar portion 16 of keeper 14 engaging a protective cap 38 covering bottle opening 39. Note that in FIGS. 4–6, handle 30 has been omitted for clarity of illustration. FIG. 5 illustrate the result of movement of collar 8 downwardly and to the right in FIG. 5 which permits keeper 14 to pivot downwardly in the direction of arrow 40 from the solid line position to the dashed position of FIG. 5. Once keeper 14 is in the dashed line position of FIG. 5, container lifter 2 is pulled upwardly as suggested by arrow 42 of FIG. 6 causing curved portion 10 of collar 8 and arcuate edge 18 of planar portion 16 of keeper 14 to engage the underside of enlarged diameter portion 24 of bottle neck 4. The position of FIG. 6 is also the position of FIG. 1; when in such a position, bottle 6 can be easily lifted and transported while remaining safely and securely engaged with bottle neck 4.

The minimum dimension D of D-shaped collar opening 22 is made to be somewhat larger than dimension B of enlarged diameter portion 24 of bottle neck 4 to permit enlarged diameter of portion 24 to pass through collar opening 22. The minimum dimension D of reduced collar opening 26 is chosen to be about the same as or slightly larger than dimension B of reduced diameter portion 28 of neck 4. Note that the reduced diameter portion 28 is defined by the thickness of protective cap 38 over bottle neck 4 as well as the diameter of the bottle neck. In the preferred embodiment arcuate edge 18 has generally the same radius of curvature as does reduced diameter portion 28, typically a 1" radius, to help ensure proper engagement of arcuate edge 18 over the entire arcuate edge. Curved portion 10 typically has a radius of 1.25" corresponding to dimension D of 2.5". Using this arrangement permits container lifter 2 to be easily mounted and secured to bottle neck 4 but also provides engagement of enlarged diameter portion 24 of bottle neck 4 by container lifter 2 over about 300° of portion 24.

Figure 7A:
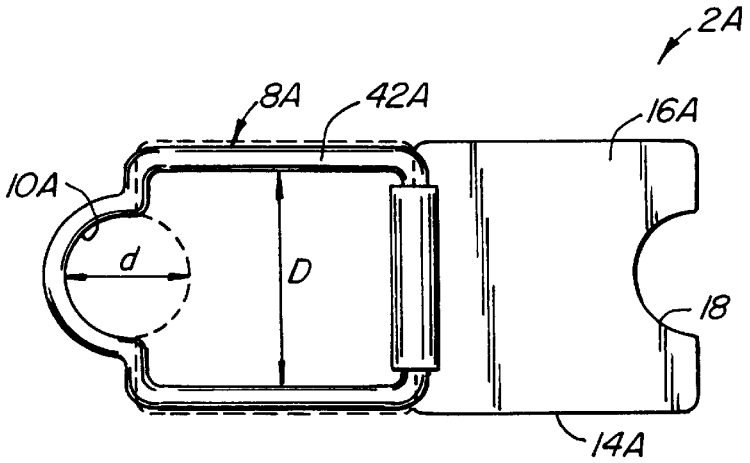
FIGS. 7A, 7B, and 7C illustrate alternative embodiments of the bottle lifter of FIG. 3 with the handle for each being omitted for clarity of illustration.

FIG. 7A illustrates an alternative embodiment of the invention in which curved portion 10A of collar 8A has a radius of curvature equal to the radius of curvature of edge 18 of keeper 14A. In this embodiment the legs 42A of collar 8A are longer than the embodiment of FIG. 3 to permit enlarged diameter portion 24 of bottle neck 4 to pass easily through the collar. The FIG. 7A embodiment of container lifter 2A will engage enlarged diameter portion 24 over substantially 360° of portion 24, as opposed to the approximately 300° of the embodiment of FIG. 3.

Figure 7B:
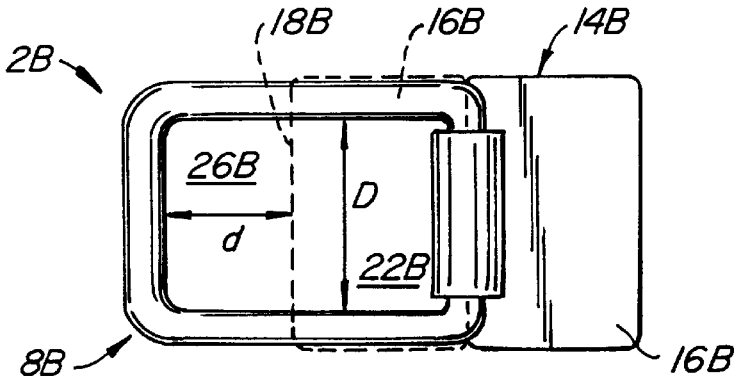

FIG. 7B illustrates the embodiment of the invention in which collar 8B is rectangular creating a rectangular collar opening 22B. Planar portion 16B of keeper 14B has a straight edge 18B so that reduced collar opening 26B is also generally rectangular. While this configuration will not provide as great a range of circumference engagement when bottle neck 4 is generally cylindrical, in some circumstances it may provide sufficient engagement. Also, an embodiment similar to FIG. 7B could be used when bottle neck 4 is rectangular rather than circular in cross-sectional shape. Of course other bottle neck cross-sectional shapes can be accommodated by the appropriate shaping and sizing of the reduced collar opening 26.

Figure 7C:
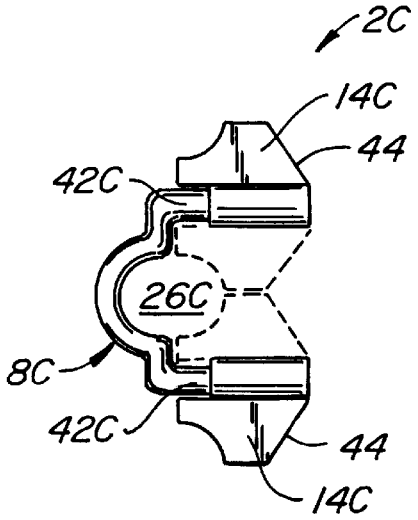

FIG. 7C illustrates an embodiment somewhat similar to FIG. 7A but in which keeper 14 has been divided into keeper halves 14C, each keeper half physically mounted to a leg 42C of collar 8C. Such a configuration may be useful when it is necessary to mount the container lifter laterally onto the neck of a bottle. To facilitate this lateral engagement, the far edges 44 of keeper halves 14C are angled to help promote movement of the keeper halves from their spring biased, dashed line positions to enable the bottle neck to pass into reduce collar opening 26C. Keeper halves 14C along edges 44 may be other than flat to help the pivoting of the keeper halves upon engagement of edges 44 with the bottle neck.

Figure 8:
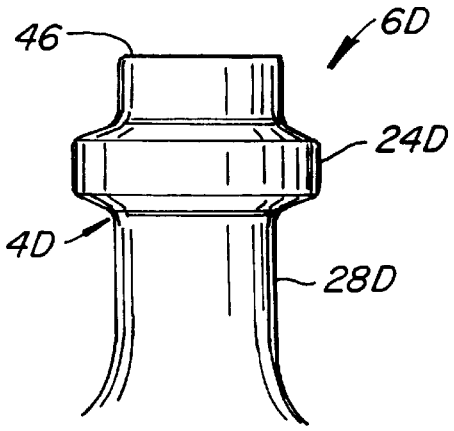
FIG. 8 illustrates an alternative neck design in which the enlarged-diameter portion is spaced apart from the bottle opening at the rim of the bottle.

The above described embodiments have been described with reference to bottle 6 having enlarged diameter portion 24 at bottle opening 39. FIG. 8 illustrates an alternative embodiment of bottle 6D in which bottle neck 4D has an enlarged diameter portion 24D spaced apart from the rim 46 of the bottle. Also, bottle 6D does not have a protective cap 38 as does bottle 6.

Other modification and variation can be made to the disclosed embodiments without departing from the subject of the invention as defined in the following claims.

Any and all patents, applications and publications referred to above are incorporated by reference.

What is claimed is:

1. A container lifter, for engaging and carrying a singe container having a body and a neck extending from the body, the neck having an enlarged-diameter portion and a reduced-diameter portion between the enlarged-diameter portion and the body, the container lifter comprising:

a collar defining a single collar opening and a neck engaging formation, the neck engaging formation extending along an arc defining a first radius larger than the enlarged-diameter portion to seat snugly against a first portion of the reduced-diameter portion of the neck;

a keeper, defining a neck engaging formation extending alone an edge portion thereof, said edge portion extending along an arc at a second radius, said second radius being smaller than the first radius and being generally equal to the radius of the reduced diameter portion, to seat snugly against a second portion of the reduced-diameter portion of the neck, said keeper mounted to the collar for movement between a first position, spaced apart from the collar opening, and a second position, partially covering the collar opening to define a reduced collar opening in which the keeper cooperates with the collar to embrace the reduced diameter portion of the neck between the neck engaging formations of the collar and the keeper, respectively;

means for biasing the keeper towards the second position;

the keeper and the collar being sized and shaped to define a generally circular reduced collar opening;

a handle extending from the collar, the handle and the collar being a rigid, one-piece assembly;

the collar opening sized to permit the enlarged-diameter portion to pass therethrough;

the reduced collar opening sized to permit the reduced-diameter portion to pass therethrough but prevent the enlarged-diameter portion from passing therethrough;

the handle comprising a cushioned handgrip generally centered on the reduced collar opening so as to help prevent twisting or cocking of the container lifter relative to the neck of the container and to enhance comfort when a container is engaged and is manually being carried by a person gripping the cushioned handgrip.

2. A container lifter, for use with a container having a neck positioned between a container body and a laterally directed protrusion positioned toward a mouth of the container, the container lifter including a collar defining:

a neck receiving space in which the neck of the container is receivable and a first neck engaging formation dimensioned to seat snugly against a first portion of the neck; and a laterally directed mouth through which the neck of the container can be passed in a lateral direction to be positioned in the neck receiving space;

two keepers, defining a second neck engaging formation dimensioned to seat snugly against a second portion of the neck, each keeper being in the form of a gate hingedly mounted on the collar at opposed positions across the mouth, the keepers being displaceable between a neck receiving condition, in which they are clear of the mouth to permit the neck to be passed laterally through the mouth and into the neck receiving space, and a neck engaging condition, in which the keepers extend across the mouth to partially cover the neck receiving space and cooperate with the collar to embrace the neck between the neck engaging formations of the collar and the keepers in a neck engaging space defined therebetween; and a handle connected to the collar for lifting the container when its neck is engaged between the neck engaging formations of the collar and the keepers.

* * * * *